United States Patent [19]

Kataoka

[11] Patent Number: 4,613,315

[45] Date of Patent: Sep. 23, 1986

[54] DOLL TOY

[75] Inventor: Isamu Kataoka, Narashino, Japan

[73] Assignee: Takara Co., Ltd., Tokyo, Japan

[21] Appl. No.: 703,349

[22] Filed: Feb. 20, 1985

[30] Foreign Application Priority Data

Nov. 9, 1984 [JP] Japan ..... 59-236259

[51] Int. Cl.[4] ..... A63H 3/22

[52] U.S. Cl. ..... 446/355; 446/276

[58] Field of Search ..... 446/276, 275, 278, 356, 446/355, 354, 353, 304, 376, 377, 378

[56] References Cited

U.S. PATENT DOCUMENTS 2,978,834 4/1961 Gardel et al. ..... 446/356 X
3,514,899 6/1970 Bonanno et al. ..... 446/304 X
3,548,537 12/1970 Robbins ..... 446/355

FOREIGN PATENT DOCUMENTS 174835 9/1906 Fed. Rep. of Germany ..... 446/378
636260 4/1950 Fed. Rep. of Germany ..... 446/355

*Primary Examiner*—Mickey Yu
*Attorney, Agent, or Firm*—Price, Gess & Ubell

[57] ABSTRACT

A doll toy comprising hollow upper and lower body portions. The lower body portions are adapted to wag relative to the upper body portion by a swinging mechanism provided within the upper and lower body portions. The doll toy has a switch provided within a mouth portion and adapted to be actuated by a teething ring or the like for actuating a motor to drive the swinging mechanism. The legs of the doll toy are adapted to be bent around knee portions. With this arrangement, the doll toy can assume a crawling mode and an upright walking mode.

5 Claims, 7 Drawing Figures

DOLL TOY

BACKGROUND OF THE INVENTION

1. Field of the Invention

This invention relates to a doll toy which is capable of walking on its hands and legs, i.e. crawling, and upright walking with a child player.

2. Prior Art

Doll toys are very popular toys for girls and many proposals have been made to provide a variety of doll toys. Among these are toys which can crawl or walk with a player.

However, these conventional doll toys generally only have one function of the two and none of the conventional doll toys can both crawl and upright walk with a player. In addition, the manner in which the conventional doll toys crawl or walk are rather mechanical and lacks reality and loveliness.

SUMMARY OF THE INVENTION

The present invention has been made to obviate the abovementioned shortcomings involved in the conventional doll toys.

It is therefore an object of the present invention to provide a doll toy which is capable of walking on its hands and legs and walking with a player only by operating its legs, i.e., bending its legs and stretching the same, respectively, thereby permitting a variety of playing mode.

It is another object of the present invention to provide a doll toy whose crawling and walking manner provides reality and loveliness.

According to the present invention, there is provided a doll toy which is formed of an upper body portion and a lower body portion and wherein the lower body portion is swingable relative to the upper body portion and legs of the lower body portion are bendable. With this arrangement, a doll toy can both crawl and walk and can make these movements with its whole lower body portion swinging and its hips wagging, thus providing a vivid and lovely appearance.

DESCRIPTION OF PREFERRED EMBODIMENT

Figure 1:
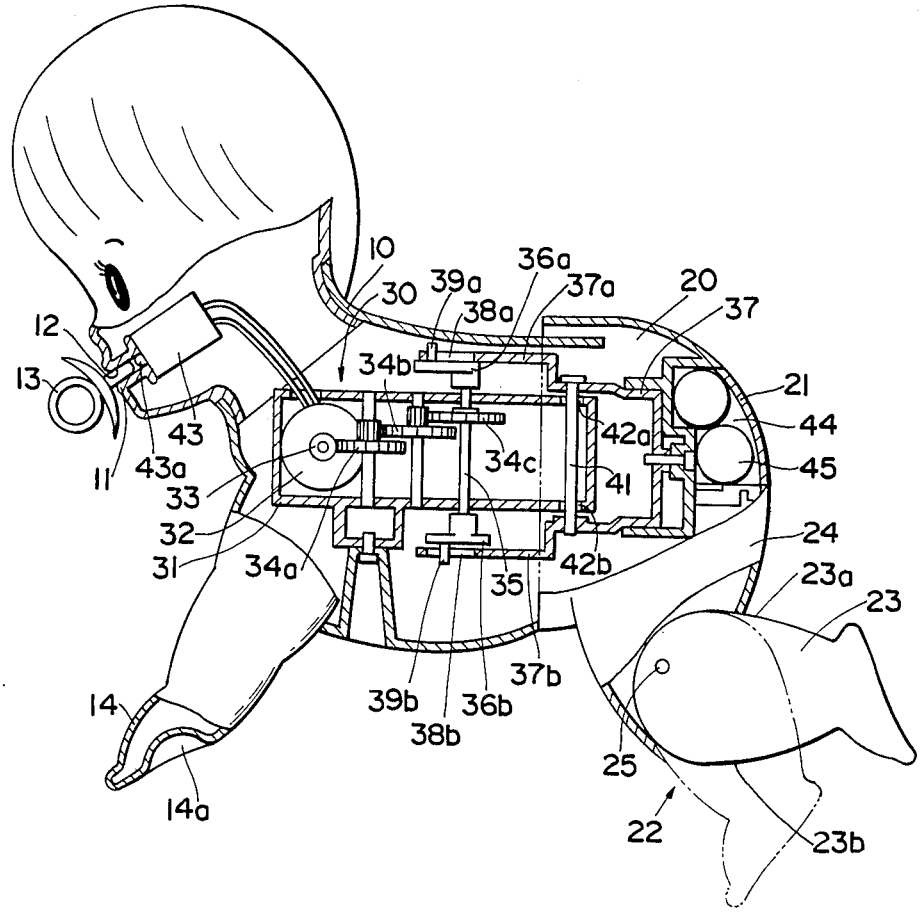
FIG. 1 is a side elevational view partly in section of one preferred form of the doll toy of the present invention, showing the same in its crawling mode.
Figure 2:
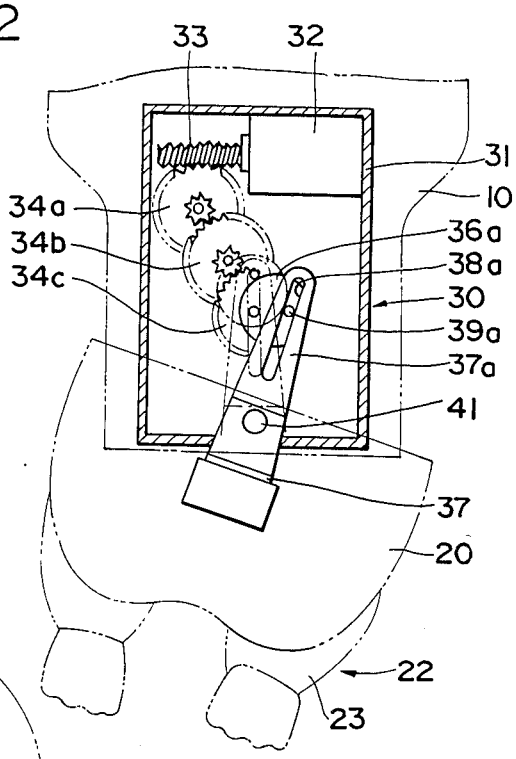
FIG. 2 is a plan view of a power unit.

The present invention will now be described by referring to a preferred embodiment illustrated in the drawings.

In the drawings, 10 is an upper body portion of a doll toy with its arms stretched and 20 is a lower body portion with its knees bent. The upper body portion 10 and the lower body portion 20 are formed in separate members. The lower body portion 20 is fitted swingably to the upper body portion through a power unit 30.

Figure 3:
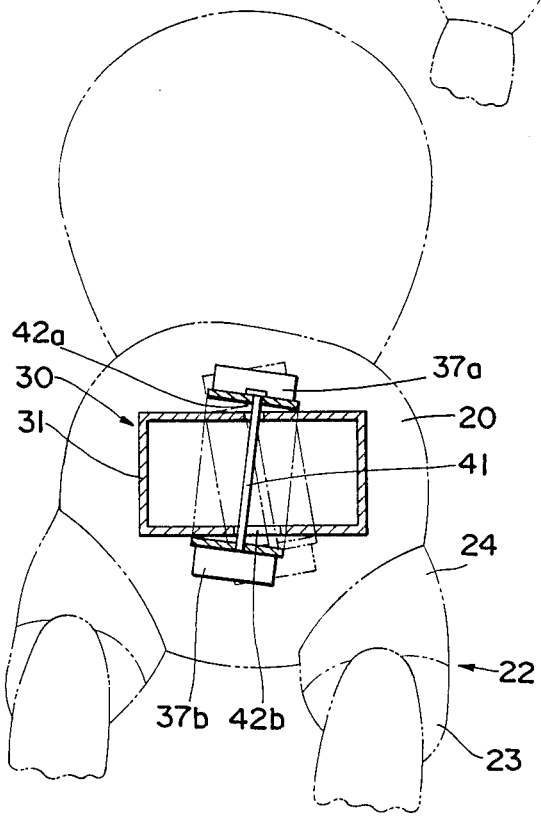
FIG. 3 is a rear view of the power unit of FIG. 2.

The power unit 30 constitutes a swinging mechanism and a casing 31 thereof is accommodated in and fixed by screws to the upper body portion 10 A motor 32 of a driving source, a worm gear 33 and reduction gears 34*a*, 34*b* and 34*c* which are in mesh with the worm gear 33 are provided in the casing 31. Cranks 36*a* and 36*b* are connected to opposite ends of a shaft 35 supporting the reduction gears 34*c* which project out of the casing 31. A connecting member 37 having two arm plates 37*a* and 37*b* extending into the upper body portion 10 is incorporated in and fixed by screws to the lower body portion 20. The connecting member 37 is engaged with pins 39*a* and 39*b* projected from the cranks 36*a* and 36*b*, respectively through elongated slots 38*a* and 38*b* formed at tip end portions of the respective arm plates 37*a* and 37*b*. The connecting member 37 is rotatably connected to a rear end portion of the casing 31 through engagement of a pin 41 with openings 42*a* and 42*b* of the casing 31. The opening 42*a* formed on the back side is rather small and has a size adapted to loosely receive the pin 41 and the opening 42*b* formed on the ventral side is elongated transversely (refer to FIG. 3).

With this arrangement, the lower body portion 20 can be wagged right and left around the pin 41, by the motor 32, through the worm gear 33, the reduction gears 34*a*, 34*b* and 34*c*, the shaft 35, the cranks 36*a* and 36*b*, and the elongated slots 38*a* and 38*b* of the arm plates 37*a* and 37*b*. The lower body portion 20 can further swing up and down according to said wagging by the arrangement of the openings 42*a* and 42*b*.

43 is a switch for the motor 32 and comprises a pushbutton 43*a* provided in a hole 12 formed at a mouth portion of a face of the doll toy. When a teething ring 13 is inserted into the hole 12 to depress the pushbutton 43*a*, the switch 43 is turned on and when the teething ring 13 is loosened or removed, the switch 43 is turned off. Since the switch 43 is not disposed to the outside, the appearance of the doll toy is not spoiled and by the switch means the means for operating the switch 43 is a baby tool, the reality and loveliness are enhanced.

44 is a casing for batteries 45 which is provided at a hip portion 21 of the lower body portion 20. These batteries 45 are for supplying power to the motor 32.

Hands of the upper body portion 10 each have a hollow 14*a* at palms thereof. Legs 22 of the lower body portion 20 are capable of bending and stretching at respective knee portions thereof. More specifically, each of lower legs 23 below the knee is rotatably connected to a thigh 24 by a pivot means 25. The pivot means 25 is formed of projections provided on the inner faces of the thigh 24 and recesses provided on the outer faces of the lower leg at positions corresponding to the projections. The projections are fitted in the recesses, respectively so as to rotate relative to the same. The pivotal means 25 may of course have another formation. When the lower leg 23 is turned, the doll toy assumes a posture for crawling with its knees bent. When the lower leg 23 is straightened, the doll toy assumes a posture for tottering.

When the lower leg 23 is bent, a calf portion 23*a* functions as a stopper to prevent further bending of the leg. When the lower leg 23 is stretched, a convexed portion 23*b* formed at a lower portion of the knee functions as a stopper to prevent the lower leg can not be bent reversely. In this connection, it is to be noted that an outer diameter of a portion of the lower leg portion 23 which is in contact with the thigh portion 24 is substantially equal to an inner diameter of the thigh portion 24 or even slightly larger than the inner diameter of the thigh, so that the lower leg portion 23 can be rotated only when a player forces to rotate the same.

Figure 4:
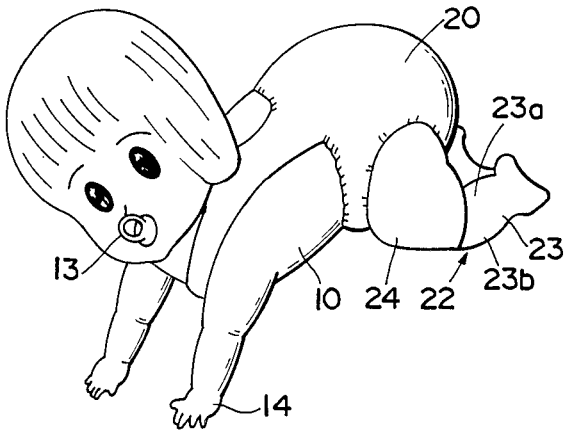
FIG. 4 is a perspective view of the doll toy which is walking on its hands and legs.

In the doll toy arranged as described above, when the lower leg portion 23 is bent to assume a posture for crawling and the teething ring 13 is inserted into the hole 12 of the mouth portion 11, the switch 43 is turned on and the power unit 30 is actuated. As a result, the doll toy begins to crawl forwardly with the lower body portion 20 wagging (refer to FIG. 4).

Figure 5:
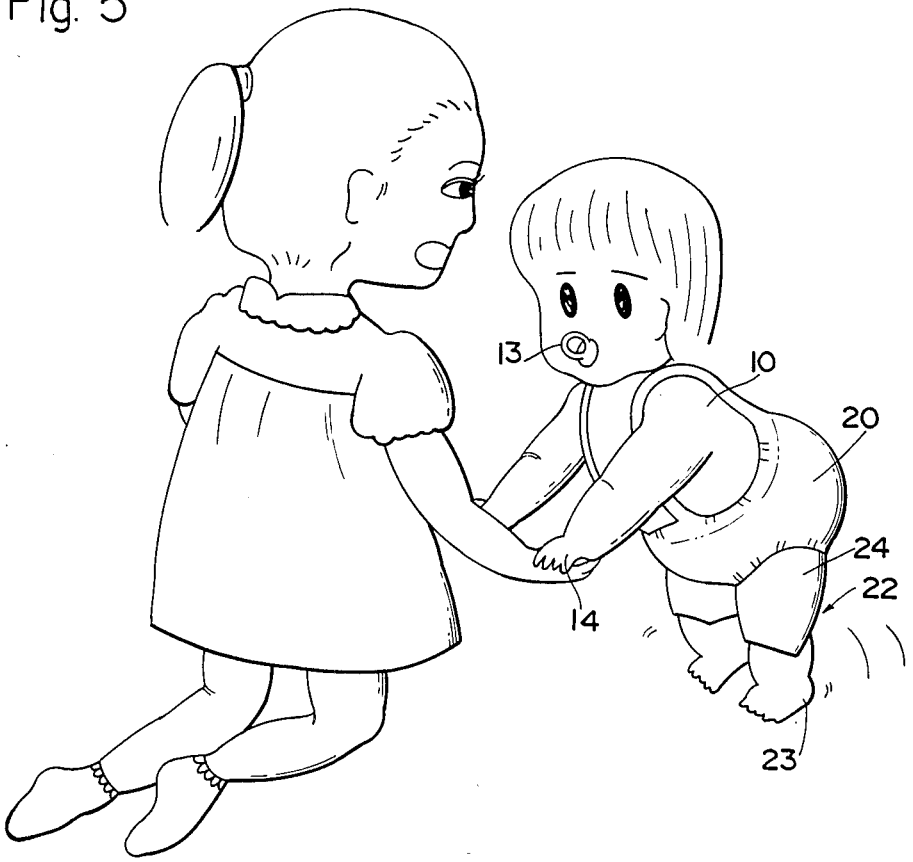
FIG. 5 is a perspective view of the doll toy which is walking with a player.

Alternatively, when the lower leg portion 23 is turned to stretch the leg and the teething ring 13 is inserted into the hole 12 of the mouth portion 11 while a player holding the hands of the doll toy, the lower body portion 20 begins rolling to attain walking with the player with its entire body wagging left and right (refer to FIG. 5).

Figure 6:
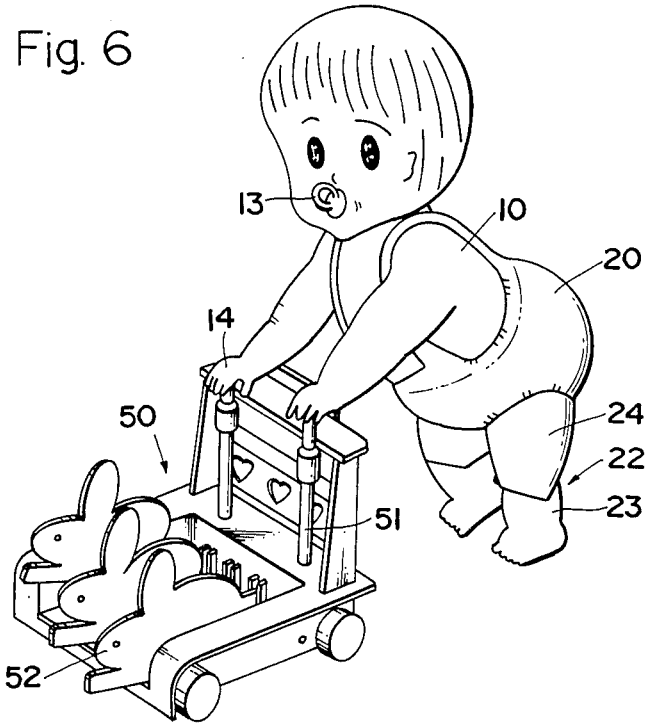
FIG. 6 is a perspective view of the doll toy which is walking with a walking aid.
Figure 7:
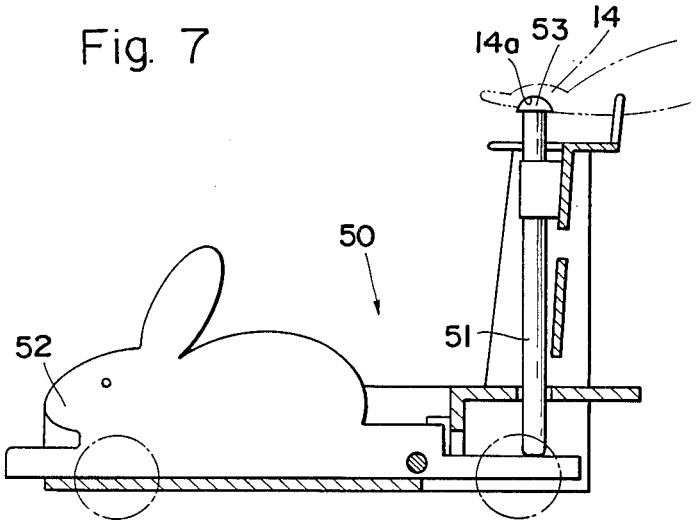
FIG. 7 is an elevational view partly in section of the walking aid of FIG. 6.

Further alternatively, when the lower body portion 23 is turned to straighten the leg and the teething ring 13 is inserted into the mouth portion 11 in a state the doll toy holds the walking aid 50, the lower body portion 20 begins rolling to walk while pushing the walking aid 50 with the entire body wagging (refer to FIG. 6). In this case, if the walking aid 50 is provided with push rods 51 and up-and-down rods having shapes of animals etc. and the hollows 14*a* of the palms 14 of the doll toy are engaged with the push rods, respectively, the push rods 51 are alternatingly depressed every rolling of the doll toy and the up-and-down rods 52 are moved up and down. The push rods 51 preferably have engaging pads of rubber material provided on the tops thereof to ensure stable engagement of the push rods 51 with the hollows 14*a* of the palms, preventing undesired releasing therefrom.

Although the switch 43 is adapted to be turned on or off by the operation of the pushbutton 43*a* in the foregoing embodiment, the switch may be a reed switch or of other types of switches. The teething ring 13 used for operating the switch 43 may be replaced with a baby's bottle or other baby articles.

I claim:

1. A mechanical doll toy having the capability of crawling and walking, at the option of the player, comprising:

a body member having an upper and lower portion;

a support casing member fixed inside of the upper portion, and having two apertures, one of which is disposed in one side of the support casing member and the other being elongated and in a side opposite the one side;

a first pin inside the support casing member and extending through the apertures therein;

a gear assembly mounted inside the support casing member;

motor means for driving the gear assembly;

a shaft connected to the gear assembly;

a pair of cranks, one being connected to each end of the shaft;

a pair of second pins, one being connected to each crank;

a connection member having a pair of arm plates and being fixed inside the lower portion, the length of each arm plate being of such a dimension to enter the inside of the upper portion and to be positioned on the one side and the opposite side thereto of the support casing member, and each arm plate having an elongated aperture at its tip end to engage the pair of second pins, the connecting member pivotally connected to the support casing member by the first pin;

a pair of legs connected to the lower portion, each having an upper and lower leg, each leg being articulated to permit the lower leg to pivot relative to the upper leg to simulate the composite action of the lower portion which comprises horizontal and vertical rotation depending on the position of the lower leg; and switch means for activating the motor means.

2. The invention of claim 1 wherein the lower leg portions are each exteriorly convexed on two opposite sides thereof to a degree such that, upon rotating the lower leg portions, the lower leg portions contact the respective upper leg portions before pivoting one hundred and eighty degrees.

3. The invention of claim 1 wherein that part of each lower leg portion disposed inside each respective upper leg portion is of an outside diameter slightly larger than the inside diameter of that part of the upper leg portion which encloses the lower leg portion so that the upper and lower leg portions do not freely rotate with respect to each other.

4. The invention of claim 1 further including a pair of simulated arms stationarily fixed to and extending from the upper portion of the body member so that the arms support the body member in approximately a parallel plane to a contact surface while the doll crawls or support the body member in an erect position with the arms extending in approximately a parallel plane to the contact surface while the doll walks with a player or an accessory toy.

5. The invention of claim 4 further including a pair of simulated hands, one being fixed to the end of each arm and each configured with a surface that slides along the contact surface while the doll crawls, or can be held by the player or attached to an accessory toy while the doll walks.

* * * * *